US006688728B2

(12) United States Patent
Watanabe et al.

(10) Patent No.: US 6,688,728 B2
(45) Date of Patent: Feb. 10, 2004

(54) INK-JET RECORDING HEAD, INK-JET RECORDING APPARATUS, AND ELECTRONIC EQUIPMENT

(75) Inventors: Takashi Watanabe, Kanagawa (JP); Tatsuo Furukawa, Kanagawa (JP); Mineo Kaneko, Tokyo (JP); Yasutomo Watanabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/948,594

(22) Filed: Sep. 10, 2001

(65) Prior Publication Data

US 2002/0030716 A1 Mar. 14, 2002

(30) Foreign Application Priority Data

Sep. 12, 2000 (JP) ..... 2000-277335

(51) Int. Cl.[7] ..... B41J 2/21
(52) U.S. Cl. ..... 347/43; 347/40
(58) Field of Search ..... 347/40, 43, 12, 347/15

(56) References Cited

U.S. PATENT DOCUMENTS

| | | | | | |
|---|---|---|---|---|---|
| 5,640,183 | A | * | 6/1997 | Hackleman | 347/40 |
| 5,796,416 | A | * | 8/1998 | Silverbrook | 347/47 |
| 5,943,072 | A | * | 8/1999 | Robert et al. | 347/40 |
| 5,956,056 | A | | 9/1999 | Kaneko et al. | 347/43 |
| 6,229,565 | B1 | * | 5/2001 | Bobry | 348/207 |

* cited by examiner

*Primary Examiner*—Lamson Nguyen
(74) *Attorney, Agent, or Firm*—Fitzpatrick, Cella, Harper & Scinto

(57) ABSTRACT

With an ink-jet recording head comprising multiple nozzle rows, for discharging ink of different colors, arrayed in approximately a straight line in approximately the same direction as the transporting direction of a recording medium, the positioning spacing of the nozzle rows of each of the colors is set so as to be greater than the length of the nozzle rows for discharging ink of each of the colors. This prevents bleeding on the recording medium and mixing of colors on the recording head in cases of printing at high speeds with in-line type recording heads, in an arrangement with simple modifications.

6 Claims, 16 Drawing Sheets

INK-JET RECORDING HEAD, INK-JET RECORDING APPARATUS, AND ELECTRONIC EQUIPMENT

BACKGROUND OF THE INVENTION

1. Field of the Invention

The present invention relates to an ink-jet recording head and an ink-jet recording apparatus wherein a plurality of nozzle rows for discharging ink of different colors are arrayed in approximately a straight line in approximately the same direction as the transporting direction of a recording medium. The present invention also relates to electronic equipment comprising an ink-jet recording apparatus.

2. Description of the Related Art

The ink-jet recording method performs recording of dots by forming flying droplets of ink which is a recording liquid and landing these on a recording medium such as paper or the like, and has a low noise factor due to being a non-contact method. Also, high resolution and high-speed recording is enabled by the increased density of the ink discharge nozzles, and further, no special processing such as developing or fixing is necessary for recording media such as plain paper or the like, so high-quality images can be obtained at low costs. Accordingly, this method has become widespread in recent years.

Particularly, on-demand type ink-jet recording apparatuses can be easily arranged to deal with color, and further the apparatus itself can be easily reduced in size and complexity, so widespread demand thereof in the future is expected. Also, as such color becomes commonplace, even higher image quality and speed is being required.

With such ink-jet recording apparatuses, serial scan apparatuses comprise a carriage upon which are mounted a recording head and ink tanks, and a transporting device for transporting the recording medium, wherein the recording head upon which multiple ink discharging orifices (nozzles) are arrayed in the transporting direction of the recording medium (i.e., the sub-scanning direction) is serially scanned in a direction orthogonal to the sub-scanning direction (i.e., the main scanning direction) using the carriage, and following completion of recording one line, the recording medium is transported by an amount equivalent to one pitch, following which the next image is recorded on the recording medium which has stopped again, and this is repeated, until recording is carried out on the entire recording medium.

Also, in the case of color recording, a recording head for the three colors yellow (Y), magenta (M), and cyan (C), or the four colors of these with black (B), and ink tanks thereof, are mounted on the carriage to carry out recording.

There are two types of nozzle row array configurations for such color recording heads; parallel types wherein the color nozzle rows are arrayed in parallel, and inline types wherein the color nozzle rows are arrayed inline.

Parallel types wherein the color nozzle rows are arrayed in parallel in the carriage scanning direction are generally suitable for high-speed printing, though this depends on the length of the nozzle rows. This is due to the fact that each of the colors can be discharged and overlaid in a single scan of the carriage. However, the parallel type has a problem in that the order in which the droplets of ink land differs between scanning in one direction and scanning in the returning direction, in the event that recording is performed both coming and going, so the coloring changes depending on the direction in which the carriage is traveling. There also is a problem with types which discharge ink using thermal energy in that driving heater boards must be arrayed in high precision for each of the color nozzle rows.

On the other hand, inline types wherein the color nozzle rows are arrayed inline in the transporting direction of the recording medium are advantageous with regard to reduction in the size of the head itself, and also manufacturing is relatively easy, which is advantageous in the area of costs as well.

Thus, inline type recording heads are generally advantageous regarding reduction in size and costs.

Now, in recent years, there have been increased demands for printers for PDAs, digital cameras, etc., requiring further reduction in size and increase in speed of the recording heads for ink-jet recording apparatuses.

While inline type recording heads are suitable for reduced size as described above, there are the following problems which occur in the event that the recording head scanning speed is increased (i.e., the driving frequency is increased) to perform high-speed printing.

Increased head scanning speed means that the amount of time from the current scan to the next scan is reduced, and accordingly the time from discharging ink of one color to the time of discharging the next ink color is also reduced. Consequently, bleeding at the boundary between the dots on the recording medium, or mixing of colors on the recording head face at the time of suctioning recovery, occurs, markedly deteriorating the image quality.

SUMMARY OF THE INVENTION

The present invention has been made in light of the above-described problems with the conventional art, and accordingly it is an object of the present invention to provide an ink-jet recording head, ink-jet recording apparatus, and electronic equipment, capable of preventing bleeding on the recording medium and mixing of colors on the recording head in cases of printing at high speeds with in-line type recording heads, so as to obtain high-quality images at low costs with simple modifications.

According to a first aspect of the present invention, an ink-jet recording head comprises a plurality of nozzle rows for discharging ink of different colors arrayed in approximately a straight line in approximately the same direction as a transporting direction of a recording medium, with images being recorded on the recording medium by scanning in a direction orthogonal to the arrayed direction of the nozzle rows, wherein, of the nozzle rows of different colors for discharging ink, the positioning spacing of the nozzle rows of different colors is set so as to be greater than the shortest nozzle row.

With the present invention, the positioning spacing of the nozzle rows for each color is set so as to be greater than the length of the nozzle rows of different colors for discharging ink, so a great amount of time can be purchased between the current scan and the next scan, thereby preventing bleeding on the recording medium and mixing of colors on the recording head.

A dummy nozzle may be positioned between nozzle rows for discharging ink of different colors.

The positioning spacing of the nozzle rows of different colors converted into the number of nozzles, and the length of the nozzle rows of different colors converted into the number of nozzles, may be set so as to be multiples of a natural number n, and also the amount of transporting the recording medium per time converted into the number of nozzles may be a multiple of the natural number n.

The plurality of nozzles arrayed in each of the nozzle rows may be disposed in a staggered array.

According to another aspect of the present invention, an ink jet recording apparatus comprises the above-described ink-jet recording head.

Further objects, features and advantages of the present invention will become apparent from the following description of the preferred embodiments with reference to the attached drawings.

DESCRIPTION OF THE PREFERRED EMBODIMENTS

Figure 1:
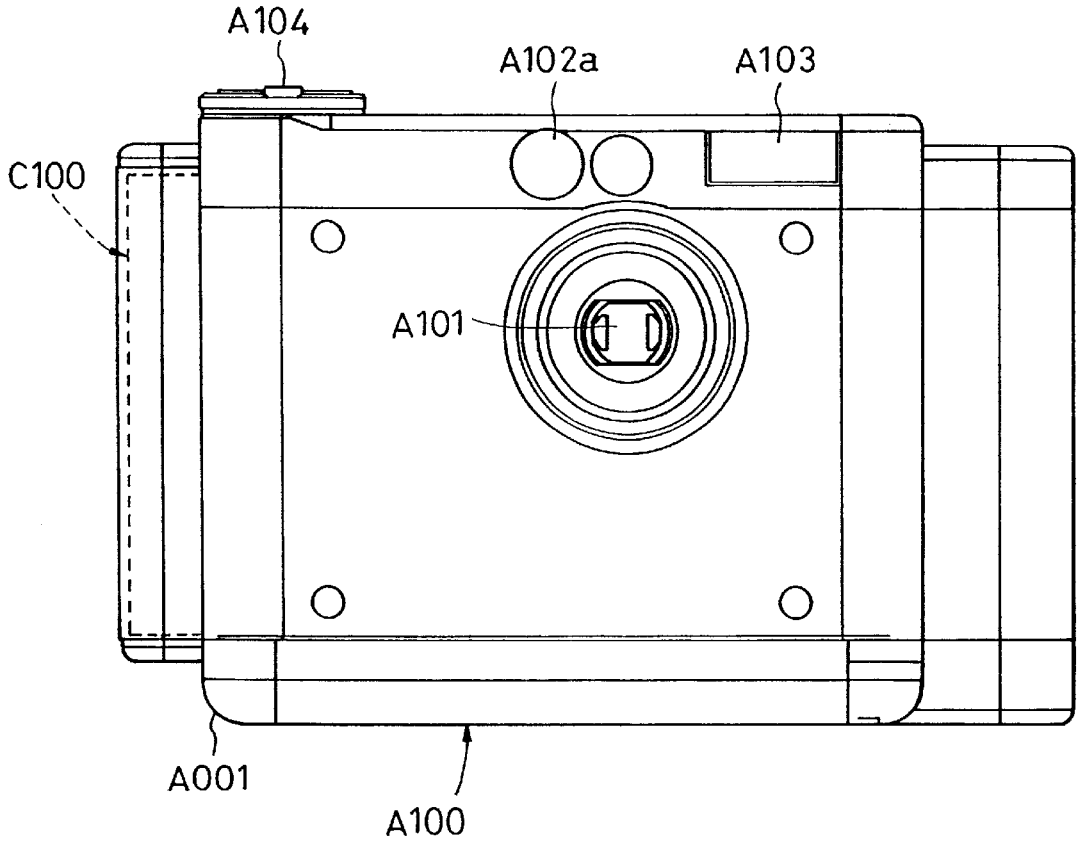
FIG. 1 is a frontal view of a camera with a built-in printer, to which the present invention can be applied.

The following is a description of the embodiments of the present invention, with reference to the drawings.

In the present specification, the term "print" (or sometimes referred to as "record") implies a broad definition of the forming of images, designs, patterns, and so forth on a printing medium or processing a printing medium with regard to such images, designs, patterns, and so forth, regardless of whether meaningful information such as characters, shapes, etc., are formed, i.e., regardless of whether that which is formed is meaningful or not, and regardless of whether that which is formed is manifested so as to be perceivable by the human eye.

Also, the term "printing medium" implies not only paper commonly used with printing apparatuses, but also broadly covers any article capable of receiving ink, such as textiles, plastic film, metal plates and the like, glass, ceramics, wood, leather, and so forth, but in the following will be referred to as "sheets" or simply "paper".

Also, in the present specification, the term "camera" implies equipment or devices for optically taking images and converting the optical images into electric signals, and will also be referred to as "image taking unit" in the following description.

Further, the term "link" (also referred to as "liquid") should be accorded the broadest interpretation as with the above term "print", and implies any liquid which could be provided for the forming of images, designs, patterns, and so forth on a printing medium, for processing a print medium with regard to such images, designs, patterns, and so forth, and for processing ink (e.g., coagulation or non-solvency of color material within ink provided to a printing medium).

Now, one form of the head suitably used with the present invention is an arrangement wherein thermal energy generated by an electro-thermal converter is used to cause film boiling in a liquid and form bubbles.

Basic Configuration

First, the basic configuration of an apparatus according to the present invention will be described with reference to FIGS. 1 through 14. The apparatus described with reference to the present example comprises information processing equipment, having an image taking unit for optically taking images and converting the images into electric signals (hereafter also referred to as a "camera unit"), and an image recording unit for recording images based on the electric signals obtained by taking the image (hereafter also referred to as a "printer unit"). In the following description, the information processing equipment described with the present example will be referred to as a "camera with built-in printer".

With an apparatus main unit A001, a printer unit (recording device) B100 is integrally assembled to the rear side of a camera unit A100. The printer unit B100 records images using ink and printing media supplied from a media pack C100. With the present configuration, as can be clearly understood from FIG. 5 which observes the apparatus main unit A001 from the rear side with the outer housing removed, the media pack C100 is inserted to the right-hand side of the apparatus main unit A001 in the drawing, and the printer unit B100 is disposed to the left-hand side of the apparatus main unit A001 in the drawing. In the event of the printer unit B100 recording, the apparatus main unit A001 may be positioned such that a later-described liquid crystal display unit A105 of the camera unit A100 faces upwards and a lens A101 faces downwards. In this recording position, a later-described recording head B120 of the printer unit B100 assumes an attitude for discharging ink downwards. Recording may be performed in the same position as that assumed for photographing with the camera unit A100, and is not restricted to the above recording position, but this recording position wherein ink is discharged downwards is preferable from the perspective of stability during the recording operation.

In the following, description of the basic mechanical configuration of the apparatus according to the present example will be made separately for A "camera unit", B "media pack", and C "printer unit", and the basic configuration of the signal processing system will be described as D: "signal processing system".

A: Camera Unit

Figure 2:
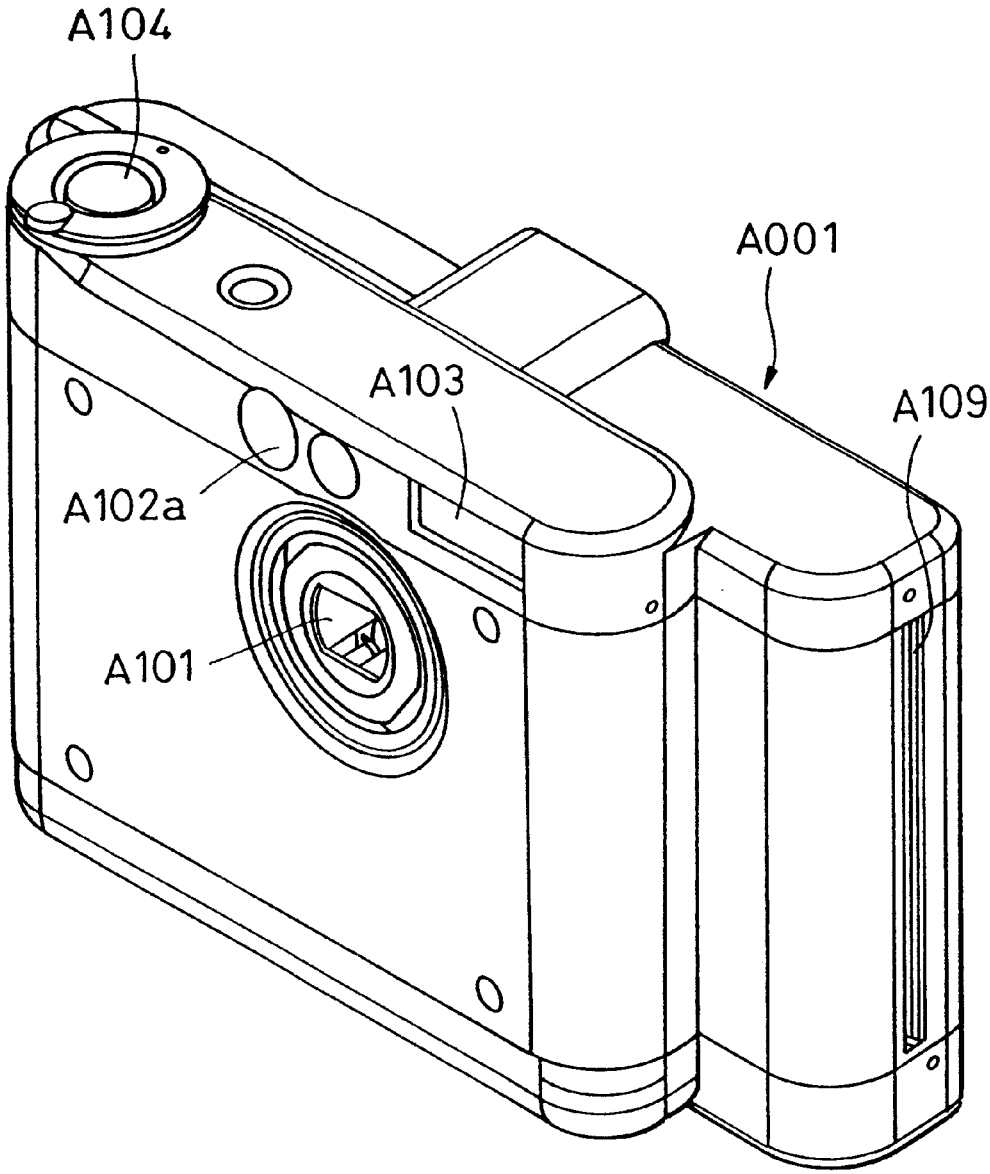
FIG. 2 is a perspective view illustrating the camera shown in FIG. 1 from a frontal diagonal direction.
Figure 3:
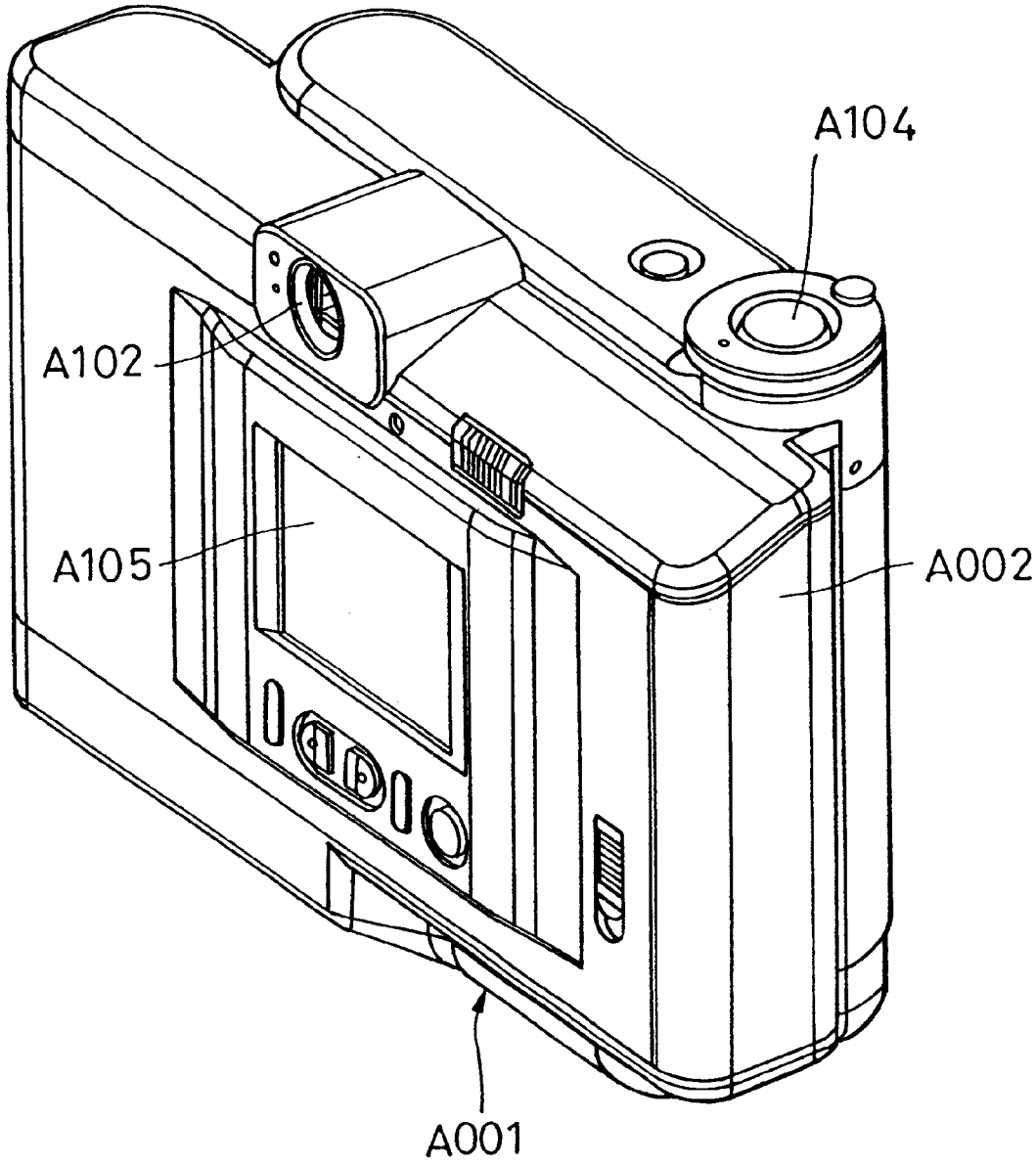
FIG. 3 is a perspective view illustrating the camera shown in FIG. 1 from a rear diagonal direction.
Figure 5:
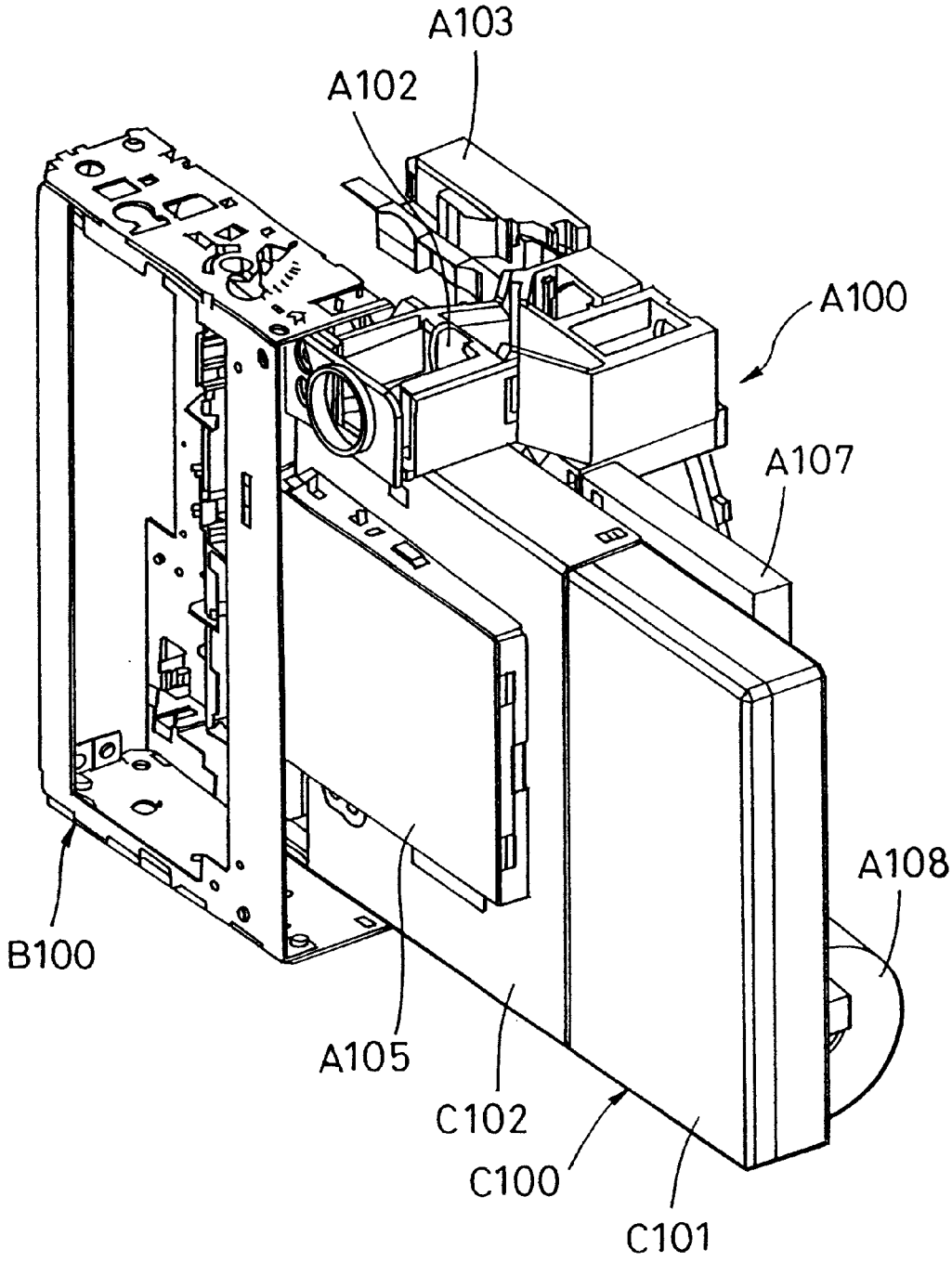
FIG. 5 is a perspective view illustrating the positional relation of the primary components disposed within the camera shown in FIG. 1.

The camera unit A100 is basically configured as a common digital camera, and is integrally assembled with the later-described printer unit B100 to the apparatus main unit A001 so as to make up a digital camera with a printer built in, having the external look such as shown in FIGS. 1 through 3. In FIGS. 1 through 3, reference numeral A101 denotes a lens, A102 denotes a viewfinder, A102*a* denotes a viewfinder window, A103 denotes a strobe, A104 denotes a release button, and A105 denotes a liquid crystal display unit (external display unit). As described later, the camera unit A100 processes data taken using a CCD, stores images to a compact flash memory card (CF card) A107, displays images, exchanges various types of data with the printer unit B100, and so forth. Reference numeral A109 denotes a discharging unit for discharging a printing medium C104 upon which the taken images are recorded. Reference numeral A108 shown in FIG. 5 is a battery serving as a power source of the camera unit A100 and the printer unit B100.

B: Media Pack

Figure 4:
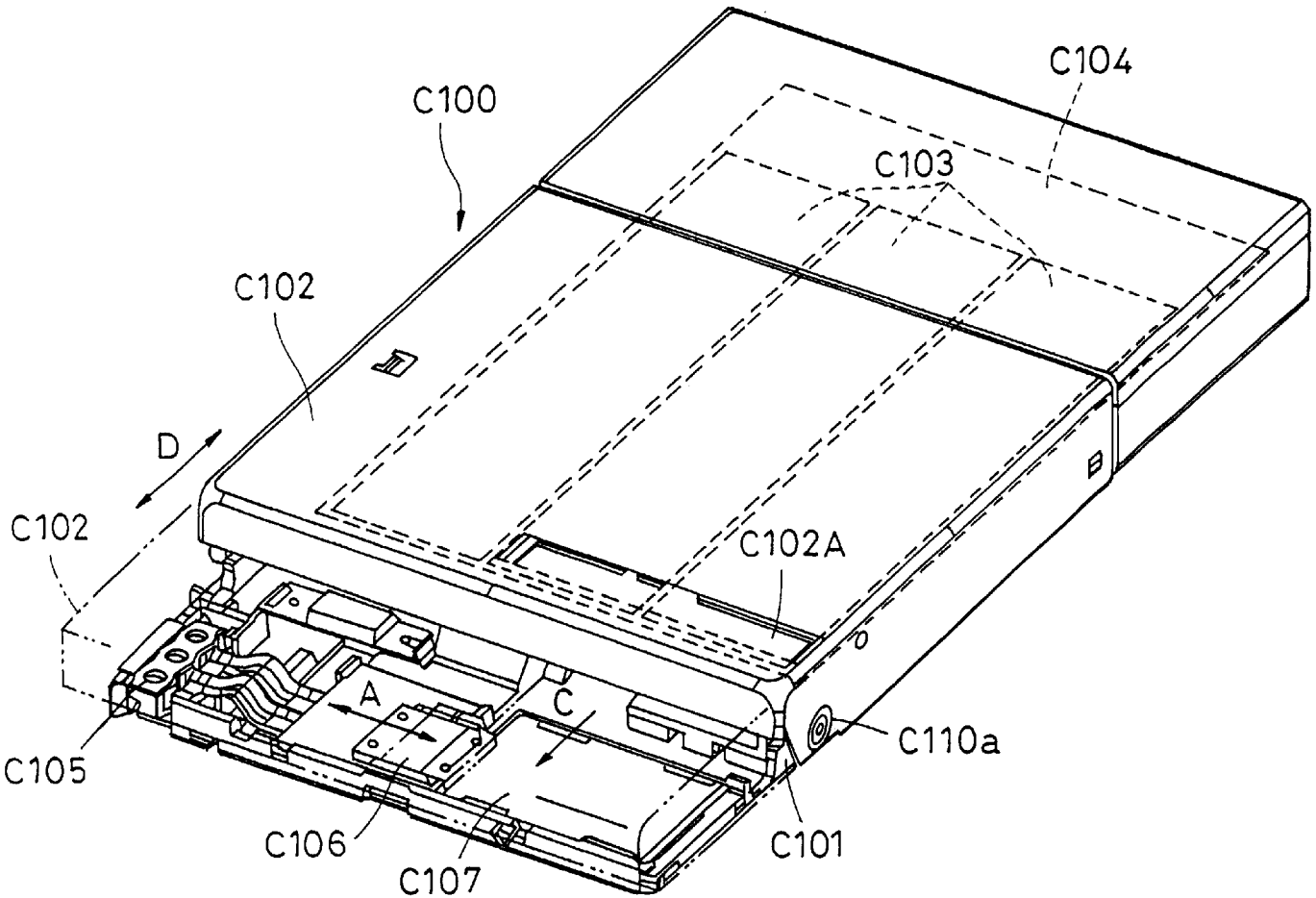
FIG. 4 is a perspective view illustrating a media pack mountable to the camera shown in FIG. 1.

The media pack C100 is detachable from the apparatus main unit A001, and with the present embodiment, is mounted to the apparatus main unit A001 as shown in FIG. 1 by being inserted in an insertion portion A002 of the apparatus main unit A001 (see FIG. 3). The insertion portion A002 is closed as shown in FIG. 3 in the event that there is no media pack C100 mounted thereto, and opens when a media pack C100 is mounted. FIG. 5 illustrates the apparatus main unit A001 with the media pack C100 mounted and the outer housing removed. As shown in FIG. 4, a pack main unit C101 of the media pack C100 has a shutter C102 which is slidable in the direction indicated by the arrow D. The shutter C102 slides to the position indicated by the two-dot broken line in FIG. 4 in the state that the media pack C100 is not mounted to the apparatus main unit A001, and slides to the position indicated by the solid line in FIG. 4 in the state that the media pack C100 is mounted to the apparatus main unit A001.

Stored in the pack main unit C101 are an ink pack C103 and a printing medium C104. In FIG. 4, the ink pack C103 is stored below the printing medium C104. In the case of the present example, the ink pack C103 individually stores three inks, Y (yellow), M (magenta), and C (cyan), and around 20 sheets are stacked and stored for the printing medium C104. The ink and the printing medium C104 are stored in the same media pack C100, the combination thereof having been selected beforehand so as to be most suitable for recording images. Accordingly, various types of media packs C100 with differing combinations of ink and printing media might be prepared, such as media packs for super-high quality, for normal images, for decals (pre-cut stickers), and so forth, so that the user can select a media pack C100 to mount to the apparatus main unit A001 according to the object of the user and the type of image to be recorded, thereby recording the image as the user intends using an optimal combination of ink and printing medium. Also, a later-described EEPROM (identifying IC) is provided to the media pack C100, and the EEPROM stores identification data regarding the types of ink and printing medium which the media pack stores, the amount remaining, and so forth.

In the state that the media pack C100 is mounted to the apparatus main unit A001, the ink pack C103 is connected to a later-described ink supply system at the apparatus main unit A001 side by three joints C105 corresponding to the respective inks Y, M, and C. On the other hand, the printing medium C104 is separated one sheet at a time by an unshown separating mechanism, and then fed in the direction of the arrow C by a later-described feeding roller C110 (see FIG. 9). The driving force of the feeding roller C110 is supplied from a later-described transporting motor M002 (see FIG. 9) provided to the apparatus main unit A001 side, via a linking unit C110*a*.

Also, provided to the pack main unit C101 are a wiper C106 for wiping a later-described recording head of the printer unit, and an ink absorbing member C107 for absorbing waste ink discharged from the printer unit. The recording head in the printer unit reciprocally moves in the main scanning direction indicated by the arrow A, as described later. In the state that the media pack C100 is removed from the apparatus main unit A001, the shutter C102 slides to the portion indicated by the two-dot broken line in FIG. 4, and thus protects the joints C105, wiper C106, ink absorbing member C107, and so forth.

C: Printer Unit

The printer unit B100 according to the present example is a serial type using an ink-jet recording head. This printer unit B100 will be described in the separate sections of C-1 "printing action unit", C-2 "printing medium transporting system", and C-3 "ink supplying system".

C-1: Printing Action Unit

Figure 6:
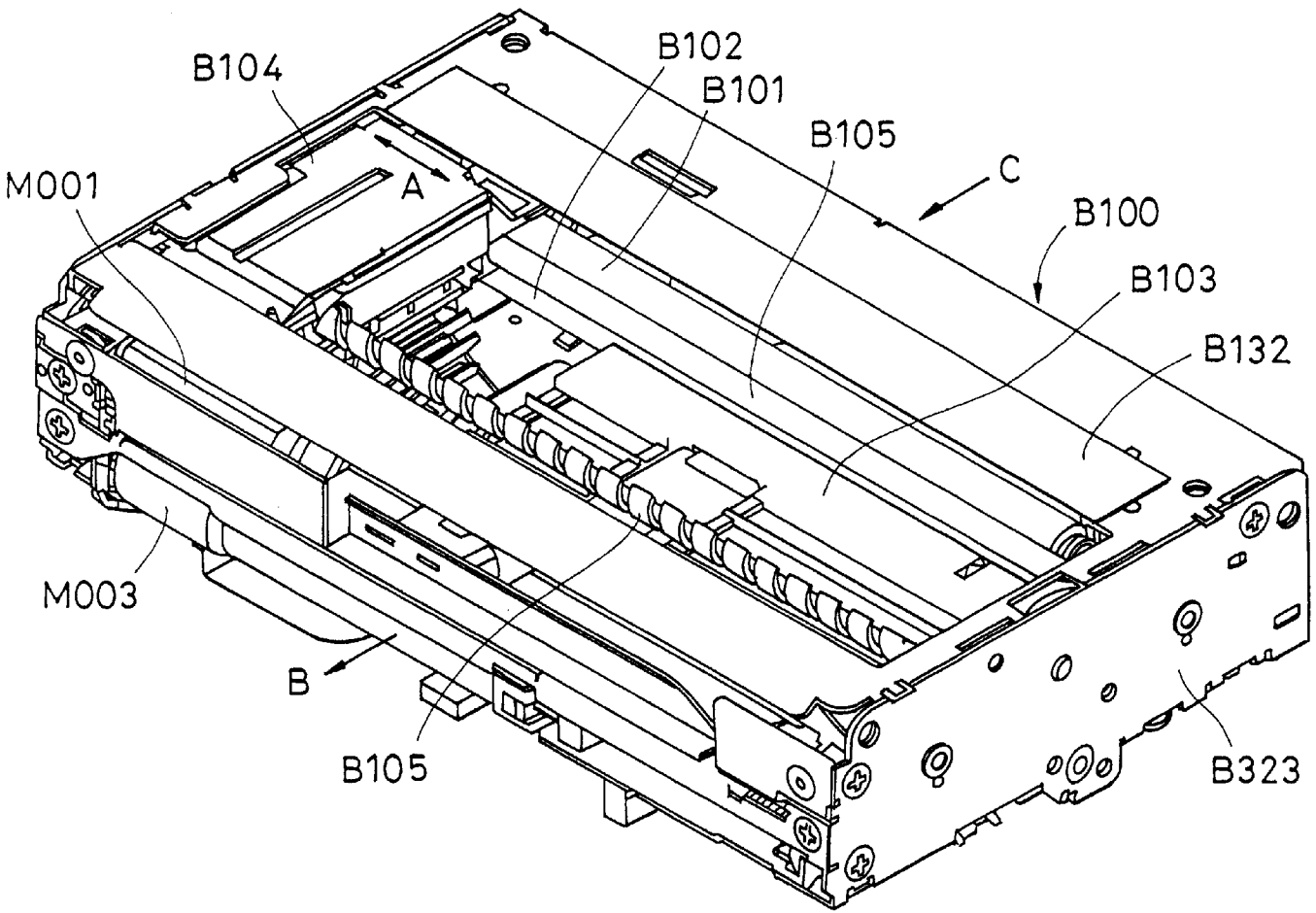
FIG. 6 is a perspective view illustrating the printer unit shown in FIG. 5.
Figure 7:
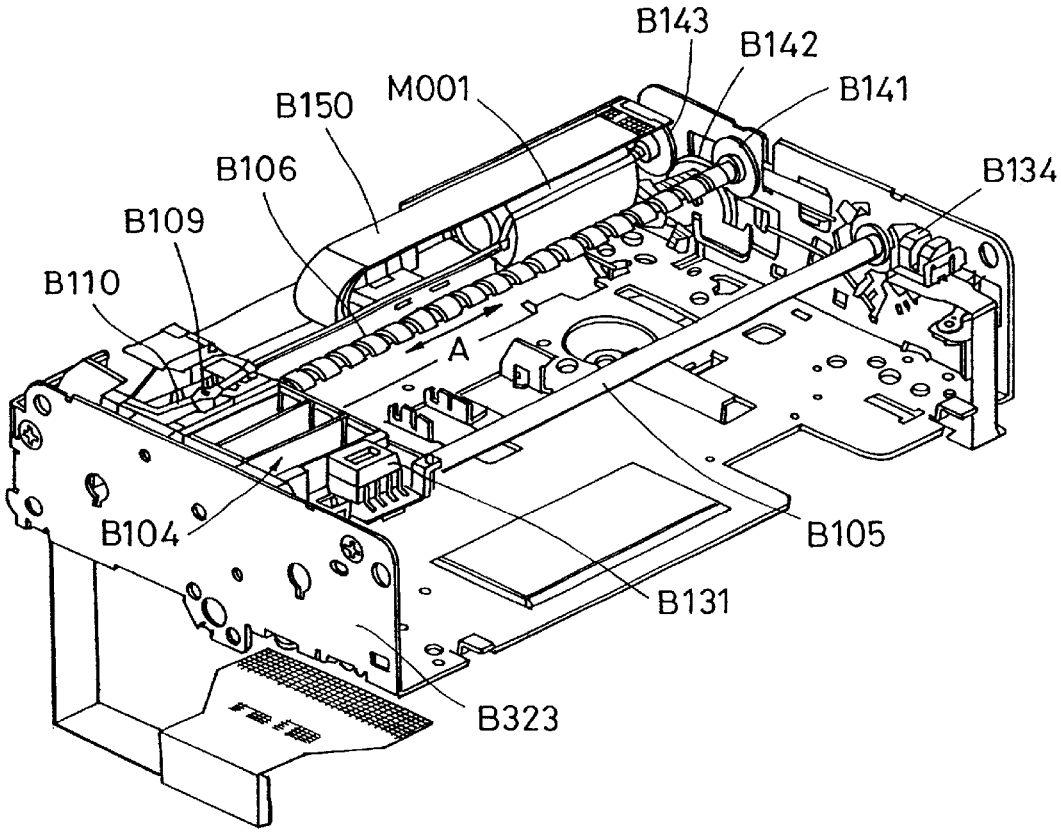
FIG. 7 is a perspective view illustrating the printer unit shown in FIG. 6 partially removed.

FIG. 6 is a perspective view of the entire printer unit B100, and FIG. 7 is a perspective view with a part of the printer unit B100 removed.

As shown in FIG. 5, the tip portion of the media pack C100 mounted to the apparatus main unit A001 is situated at a predetermined position within the main unit of the printer unit B100. The printing media C104 fed out from the media pack C100 in the direction of the arrow C is nipped by an LF roller B101 and an LF pinch roller B102 of the later-described printing media transporting system, and is thus transported in the sub-scanning direction over the platen B103 in the direction indicated by the arrow B. Reference numeral B104 denotes a carriage reciprocally driven in the main scanning direction indicated by the arrow A following a guide shaft B105 and a lead screw B106.

Figure 8:
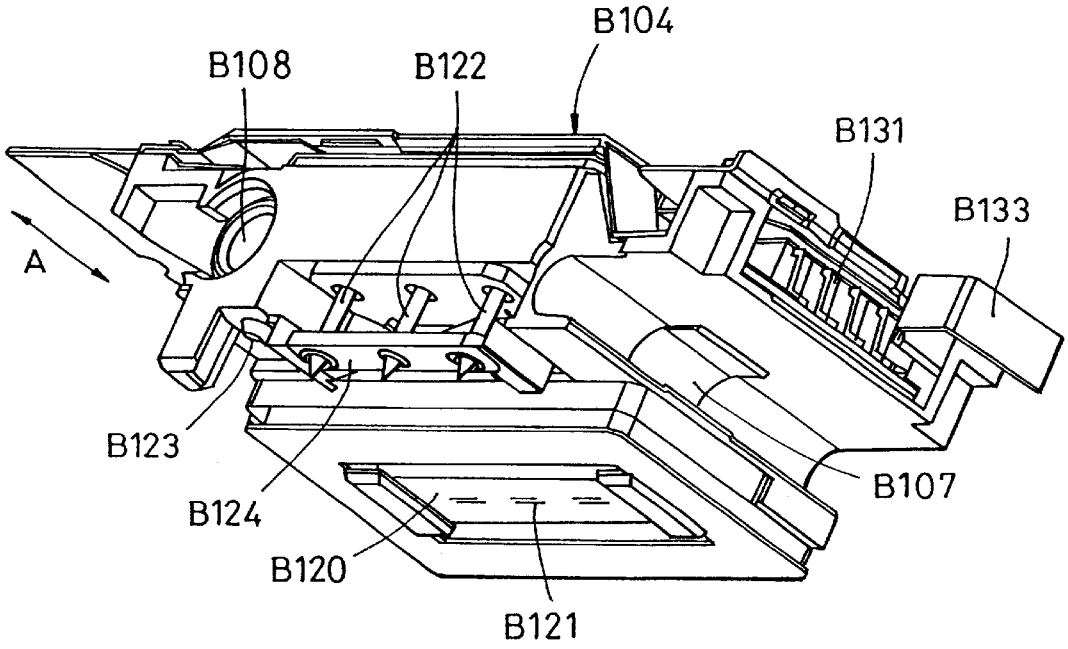
FIG. 8 is a perspective view illustrating the carriage in the printer unit shown in FIG. 6.

Provided to the carriage B104 are, as shown in FIG. 8, a bearing B107 for the guide shaft B105 and a bearing B108 for the lead screw B106. As shown in FIG. 7, a screw ping B109 protruding to the inner side of the bearing B108 is attached to a predetermined position of the carriage B104 by means of a spring B110. The tip of the screw pin B109 fits into the screw threads formed on the perimeter of the lead screw B106, such that rotation of the lead screw B106 is converted into reciprocal motion of the carriage B104.

Also, mounted on the carriage B104 are an ink-jet recording head B120 capable of discharging ink of the colors Y, M, and C, and a sub-tank (not shown) for storing ink to be supplied to the ink-jet recording head B120. The ink-jet recording head B120 has multiple ink discharging orifices B121 (see FIG. 8) formed along a direction intersecting the main scanning direction of the arrow A (in the case of the present example in the direction orthogonal thereto). The ink discharging orifices B121 have nozzles capable of discharging ink supplied from the sub-tank. Electro-thermal converters provided for each nozzle can be used for energy generating means for discharging the ink. The electro-thermal converters are driven to generate heat, which causes air bubbles in the ink within the nozzles, and the ink is discharged as droplets from the ink discharging orifices B121 by the bubble-generating energy.

The sub-tank has a capacity smaller than the ink-pack C103 stored in the media pack C100, and stores an amount of ink necessary for recording an image on at least one sheet of the printing medium C104. At the ink storing portions for the Y, M, and C inks in the sub-tank, ink supplying portions and negative pressure introduction portions are formed for each, and three hollow needles B122 are individually connected to the corresponding ink supplying portions, with the negative pressure introduction portions of each being connected to a shared supply air opening B123. Ink is supplied to such a sub-tank from the ink pack C103 of the media pack C100 at the point that the carriage B104 moves to the home position as shown in FIG. 6, which will be described later.

With the carriage B104 shown in FIG. 8, reference numeral B124 denotes a needle cover, and in the event that the needles B122 and the joints C105 are not linked the needle cover B124 moves by the pressing force of a spring to a position protecting the needles B122, but in the event that the needles B122 and the joints C105 are linked the needle cover B124 is pressed upwards in the figure against the pressing force of the spring to a position disengaging protection of the needles B122. The position to which the carriage B104 moves is detected by the encoder sensor B131 at the carriage B104 side and a linear scale B132 (see FIG. 6) at the printer unit B100 main unit side. Also, in the event that the carriage B104 moves to the home position, this is detected by a HP (Home Position) flag B133 at the carriage B104 side, and a HP sensor B134 (see FIG. 7) at the printer unit B100 main unit side.

In FIG. 7, both ends of the guide shaft B105 are provided with supporting shafts (not shown) at positions eccentric from the center axis thereof. The position of the carriage 104 is adjusted by the guide shaft B105 being rotatably adjusted on the supporting shaft, thereby adjusting the distance between the recording head B120 and the printing medium C104 on the platen B103 (this distance also referred to as "sheet distance"). Also, the lead screw B106 is rotatably driven by a carriage motor M001 via a screw gear B141, idler gear B142, and motor gear B143. Also, reference numeral B150 denotes a flexible cable for electrically connecting the recording head B120 to a later-described control system.

The recording head B120 records one line of image on the printing medium upon the platen B103 by discharging ink from the ink discharging orifices B121 according to image signals while moving in the main scanning direction of the arrow A along with the carriage B104. Repeating the one-line recording action of such a recording head B120 and the transporting action of the printing medium by a predetermined amount in the sub-scanning direction of the arrow B by a later-described printing media transporting system sequentially records images on the printing medium.

C-2: Printing Medium Transporting System

Figure 9:
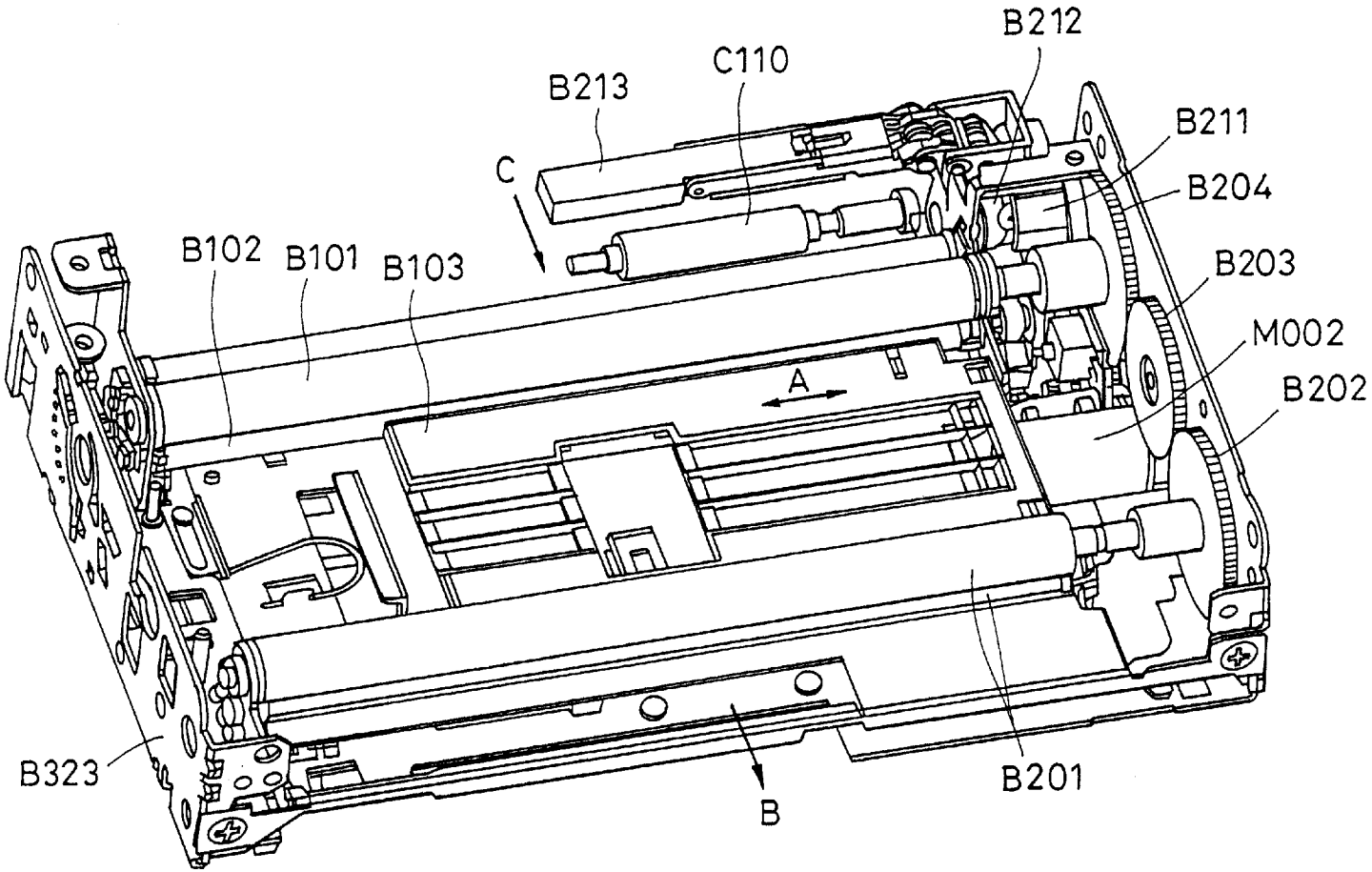
FIG. 9 is a perspective view illustrating the components of the printing media transporting system in the printing unit shown in FIG. 6.

FIG. 9 is a perspective view of the components of the printing medium transporting system in the printer unit B100. In FIG. 9, reference numeral B201 denotes a pair of discharging rollers, with the one discharging roller B201 at the upper side in the drawing being driven by a transporting motor M002 via a discharging roller gear B202 and intermediate gear B203. In the same way, the aforementioned LF roller B101 is driven by the transporting motor M002 via a LF roller gear B204 and the intermediate gear B203. The discharging roller B201 and LF roller B101 transport the printing medium C104 in the sub-scanning direction of the arrow B by the driving force of the transporting motor M002 rotating forward.

On the other hand, in the event that the transporting motor M002 rotates in reverse, a platen head B213 and a locking mechanism not shown are driven via a switching slider B211 and switching cam B212, while driving force is transmitted to the feeding roller C110 at the media pack C100 side. That is to say, the platen head B213 passes through a window portion C102A (see FIG. 4) in the shutter C102 of the media pack C100 and presses the printing medium C401 collected within the media pack C100 downwards in FIG. 4, by the driving force of the transporting motor M002 rotating in reverse. Thus, the printing medium C104 at the bottommost position in FIG. 4 is pressed downwards upon the feeding roller within the media pack C100. Also, an unshown locking mechanism locks the media pack C100 to the apparatus main unit A001 by the driving force of the transporting motor M002 rotating in reverse, thereby keeping the media pack C100 from being removed. Also, the feeding roller C110 at the media pack side C100 receives transmission of driving force of the transporting motor M002 rotating in reverse, thereby transporting the one sheet of printing medium C104 at the bottommost position in FIG. 4 in the direction indicated by the arrow C.

Thus, a single sheet of the printing media C104 is extracted in the direction of the arrow C from the media pack C100 by the transporting motor M002 rotating in reverse, and subsequently the printing media C104 is transported in the direction of the arrow B by forward rotation of the transporting motor M002.

C-3: Ink Supplying System

Figure 10:
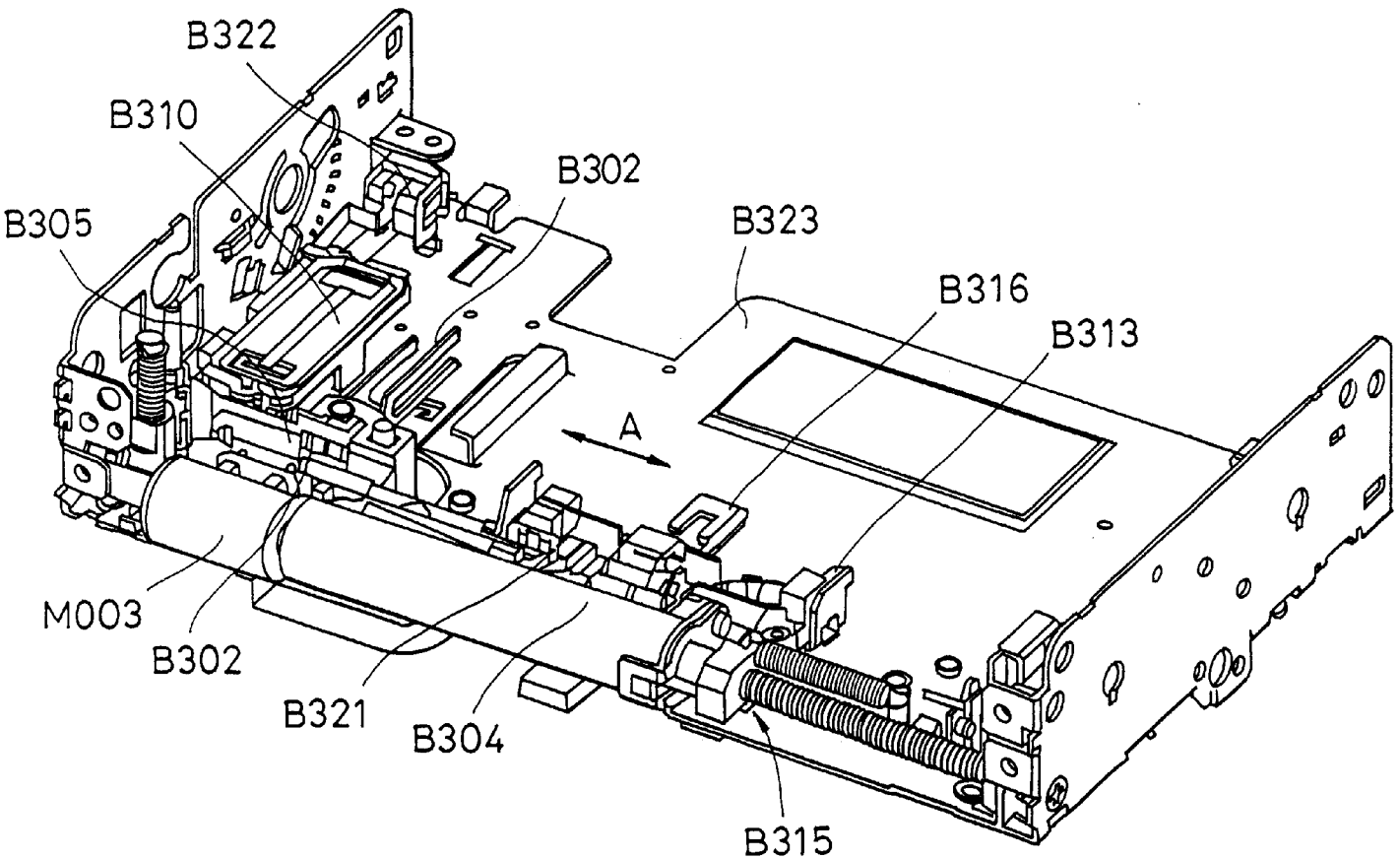
FIG. 10 is a perspective view illustrating the components of the ink supplying system in the printing unit shown in FIG. 6.
Figure 11:
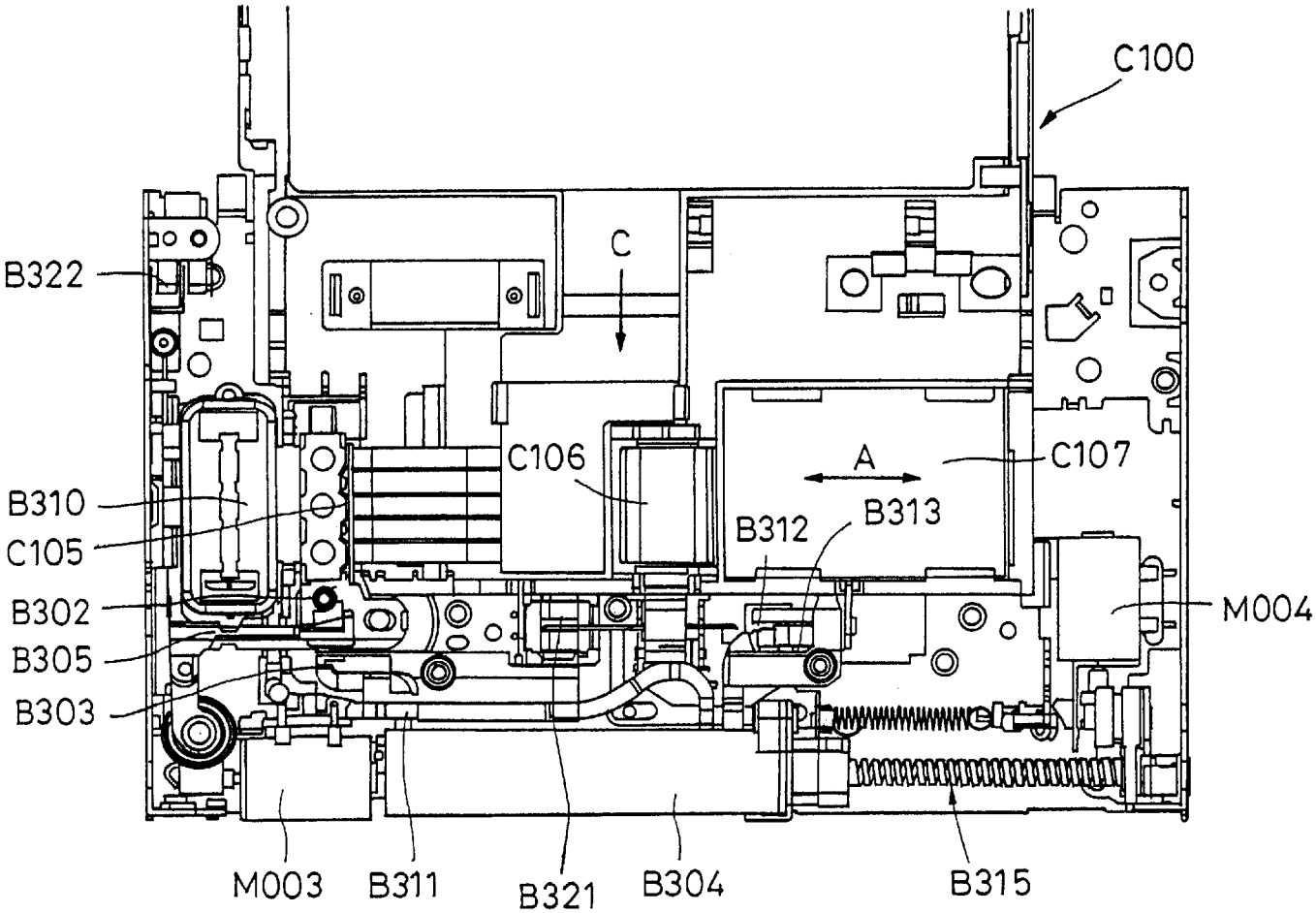
FIG. 11 is a plan view illustrating a state wherein the media pack is mounted to the components of the ink supplying system shown in FIG. 10.

FIG. 10 is a perspective view of the components of the ink supplying system in the printer unit B100, and FIG. 11 is a plan view illustrating the state in which the media pack C100 is mounted to the components of the ink supplying system.

The joints C105 of the media pack c100 mounted to the printer unit B100 are situated blow the needles B122 (see FIG. 8) at the side of the carriage B104 which has moved to the home position. Provided to the main unit of the printer unit B100 is a joint fork B301 (see FIG. 10) positioned below the joints C105, and moving the joints C105 upwards thereby connects the joints C105 to the needles B122. Thus, ink supply channels are formed between the ink pack C103 of the media pack C100 and the ink supplying portion of the sub-tank on the side of the carriage B104. Also, a supplying joint B302 situated below the supply air opening B123 (see FIG. 8) of the carriage B104 which has moved to the home position is provided to the main unit of the printer unit B100. The supplying joint B302 is connected to a pump cylinder B304 serving as a negative pressure generating source, via a supplying tube B303. The supplying joint B302 is moved upwards by a joint lifter B305 to be connected to the supply air opening B123 at the carriage B104 side. Thus, a negative pressure introducing channel is formed between the negative pressure introducing portion of the sub-tank at the carriage B104 side and the pump cylinder B304. The joint lifter B305 vertically moves the supplying joint B302 and the joint fork B301 by the driving force of a joint motor M003.

An air-liquid separating member (not shown) for permitting air to pass but preventing passage of ink is provided at the negative pressure introducing portion of the sub-tank. The air-liquid separating member passage of air within the sub-tank suctioned through the negative pressure introducing channel, and thus ink is supplied from the media pack C100 to the sub-tank. Preventing passage of ink by the air-liquid separating member at the point that ink is sufficiently filled, i.e., till the ink within the sub-tank reaches the air-liquid separating member, automatically stops filling of the ink. A air-liquid separating member is provided for the ink supplying portion in the ink storing portion for each color ink in he sub-tank, and filling of ink is automatically stopped for each ink storing portion.

Also, provided to the printer unit B100 main unit is a suctioning cap B310 capable of capping the recording head B120 (se FIG. 8) at the carriage B104 side which has moved to the home position. The suctioning cap B310 is capable of suctioning discharging of ink from the ink discharging orifices B121 of the recording head B120 by the negative pressure being introduced from the pump cylinder B304 via the suctioning tube B311 to the interior thereof (i.e., performing suctioning recovery processing). Also, the recording head B120 discharges ink not contributing to recording of the image into the suctioning cap B310 as necessary (preliminary discharging processing). Ink within the suctioning cap B310 passes from the pump cylinder B304 through the waste liquid tube B312 and the waste liquid joint B313, and is discharged into an ink absorbing member C107 in the media pack C110.

The pump cylinder B304 configures a pump unit B315 along with the pump motor M004 for reciprocal driving hereof. The pump motor M004 functions as a driving source for vertically moving a wiper lifter B316 (see FIG. 10). The wiper lifter B316 lifts a wiper C106 of the media pack C100 mounted to the printer unit B100, thereby moving the wiper C106 to a position at which wiping of the recording head B120 can be performed.

In FIGS. 10 and 11, reference numeral B321 denotes a pump HP sensor for detecting that the operating position of the pump configured of the pump cylinder B304 is at the home position. Also, reference numeral B322 denotes a joint HP sensor detecting that the above-described ink supplying channels and negative pressure introducing channel have been formed. Also, reference numeral B323 denotes a chassis configuring the main unit of the printer unit B100.

D: Signal Processing System

Figure 12:
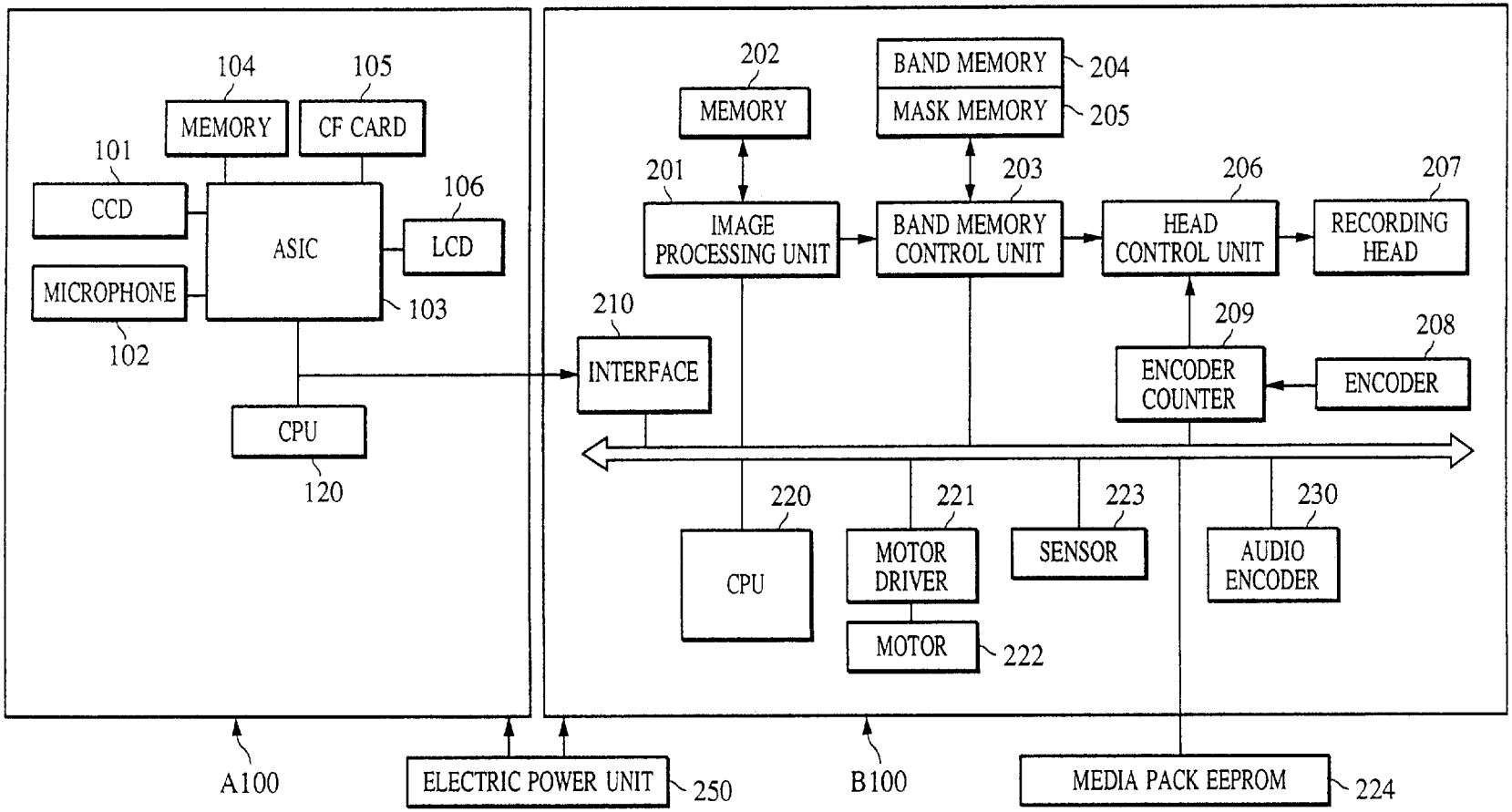
FIG. 12 is a schematic block configuration diagram of the camera unit and printer unit in the camera shown in FIG. 1.

FIG. 12 is a schematic block configuration diagram of the camera unit A100 and the printer unit B100.

With the camera unit A100, reference numeral 101 denotes a CCD serving as an image-taking device, 102 denotes a microphone for input of audio, 103 denotes an ASIC for performing hardware processing, 104 denotes a first memory for temporarily storing image data and the like, 105 denotes a CF card for storing images that have been taken (equivalent to the CF card A107), 106 denotes an LCD for displaying images that have been taken or reproduced images (equivalent to the liquid crystal display unit A105), and 120 denotes a first CPU for controlling the camera unit A100.

In the printer unit B100 reference numeral 210 denotes an interface between the camera unit A100 and the printer unit B100. 201 denotes an image processing unit (including a binarization processing unit for binarizing images), 202 denotes second memory to be used for image processing, 203 denotes a band memory control unit, 204 denotes band memory, 205 denotes mask memory, 206 denotes a head control unit, 207 denotes a recording head (equivalent to the recording head B120), 208 denotes an encoder (equivalent to the encoder sensor B131), 209 denotes an encoder counter, 220 denotes a second CPU for controlling the printer unit B100, 221 denotes a motor driver, 222 denotes a motor (equivalent to the motors M001, M002, M003, and M004), 223 denotes a sensor (including the HP sensors B134, B321, and B322), 224 denotes an EEPROM built into the media pack C100, 230 denotes an audio encoder unit, and 250 denotes an electric power source for supplying electric power to the entire apparatus (equivalent to the battery A108).

Figure 13:
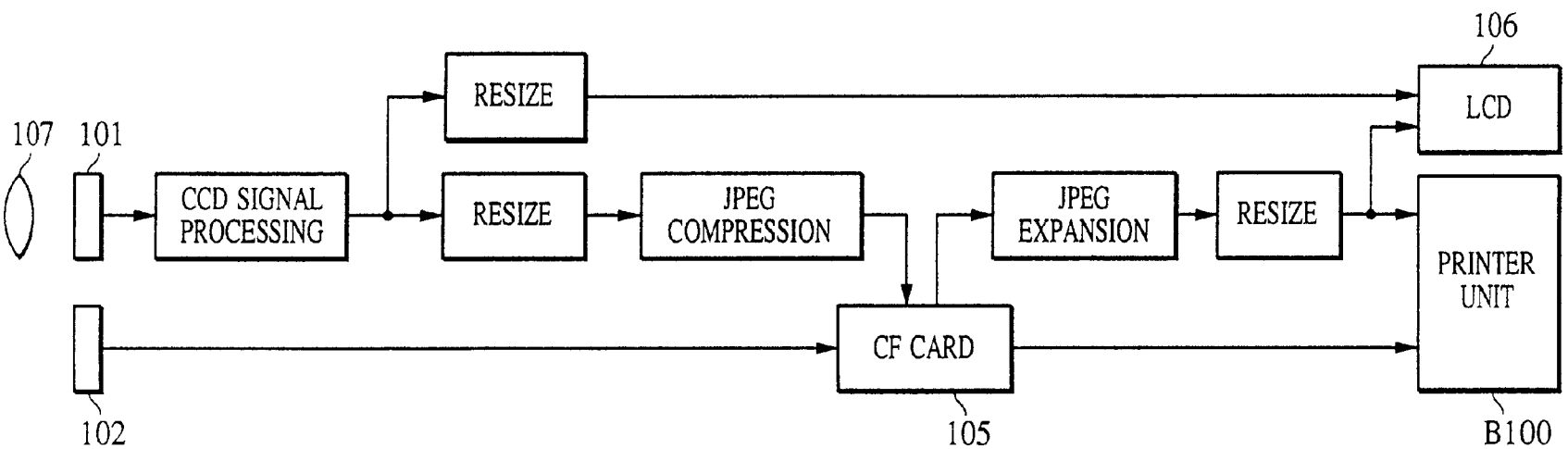
FIG. 13 is an explanatory diagram of signal processing in the camera unit shown in FIG. 12.

FIG. 13 is an explanatory diagram describing the signal processing of the camera unit A100. In the photography mode, images taken by the CCD 101 through the lens 107 are subjected to signals processing by the ASIC 103 (i.e., CCD signal processing), and converted into YUV brightness two-color difference signals. Further, the images are resized to a predetermined resolution, subjected to JPEG compressing, and recorded in the CF card 105. Also, audio is input from the microphone 102, and recorded in the CF card 105 via the ASIC 103. The audio recording may be performed simultaneously with taking the images, or as after-recording following taking the images. In the replay mode, the JPEG images are read out from the CF card 105, subjected to JPEG expansion by the ASIC 103, resized to the display resolution, and displayed on the LCD 106.

Figure 14:
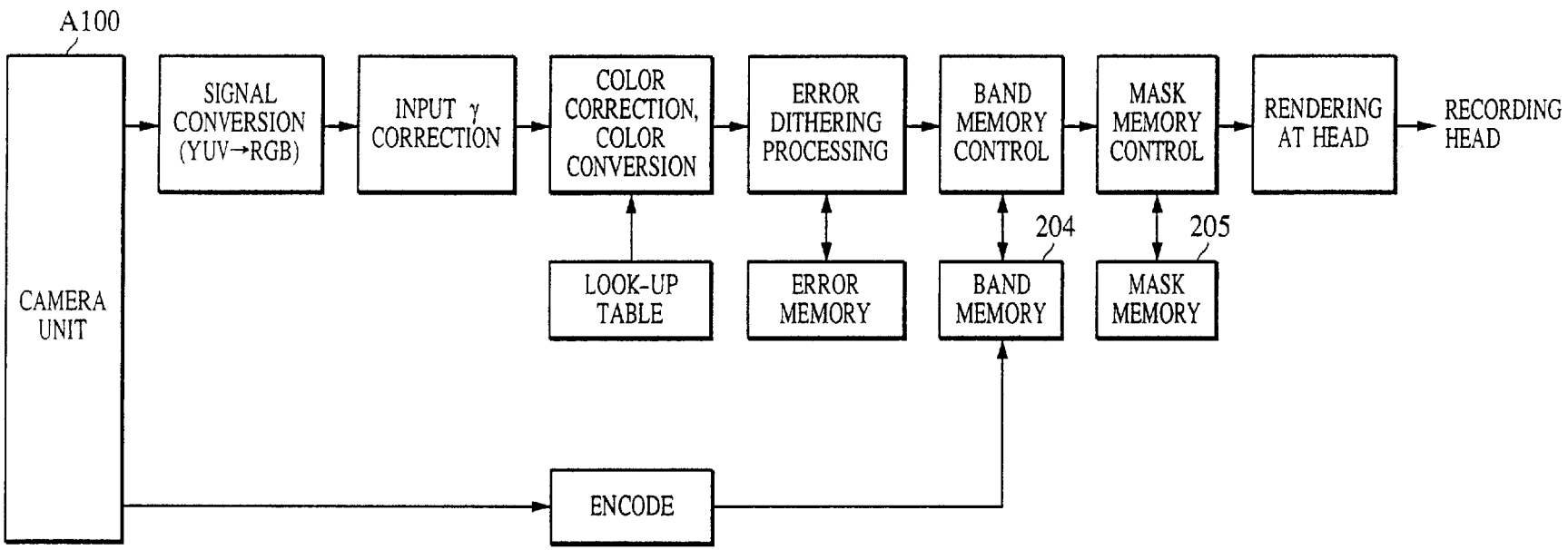
FIG. 14 is an explanatory diagram of signal processing in the printer unit shown in FIG. 12.

FIG. 14 is an explanatory diagram for describing the signals processing at the printer unit B100.

Images reproduced at the camera unit A100 side, i.e., read out of the CF card 105, are subjected to JPEG expansion by the ASIC 103 as shown in FIG. 13, and resized to a resolution suitable for printing. The resized data (YUV) is then sent to the printer unit B100 via the interface unit 210. The printer unit B100 performs image processing for the image data sent from the camera unit A100 with the image processing unit 201 as shown in FIG. 14, and performs: conversion of the image signals into RGB signals; input ã correction according to properties of the camera; color correction and color conversion using a look-up table (LUT); and conversion into binary signals for printing. At the time of the binarization processing, the second memory 202 is used as error memory for error dispersion (ED) processing which is performed. In the present example, the binarization processing unit on the image processing unit 201 performs error dispersion processing, but other processing may be performed, such as binarization processing using dither patterns, or the like. The binarized print data is temporarily stored in the band memory 204 by the band memory control unit 203. The encoder counter 209 of the printer unit B100 receives input of encoder pulses from the encoder 208 each time the carriage B104 upon which the recording head 207 and the encoder 208 are mounted moves a predetermined distance. Synchronously with these encoder pulses, print data is read out from the band memory 204 and the mask memory 205, and based on the print data thereof, the head control unit 206 controls the recording head 207 to perform recording.

The band memory control in FIG. 14 is as described next.

The multiple nozzles on the recording head 207 are formed in rows with a density of 1200 dpi, for example. In the event of scanning the carriage one time to record an image using such a recording head 207, there is the need to create beforehand recording data for the number of nozzles in the sub-scanning direction (hereafter also referred to as "vertical (Y-direction)") and the recording area in the main scanning direction (hereafter also referred to as "horizontal (X-direction)"), i.e., recording data for one scan. The recording data is created by the image processing unit 201, and then temporarily stored in the band memory 204 by the band memory control unit 203. Following storing one scan of recording data in the band memory 204, the carriage is scanned in the main scanning direction. At this time, the encoder pulses input by the encoder 208 are counted by the encoder counter 209, recording data is read out from the band memory 204 following the encoder pulses, and ink droplets are discharged from the recording head based on the image data thereof. In the event of performing recording of the image with the recording head 207 scanning in both directions, i.e., both when going and when returning, image data is read out from the band memory according to the scanning direction of the recording head 207. For example, in the event of recording in the going direction, the address of the image data read out from the band memory 204 is sequentially incremented, and in the event of recording in the return direction, the address of the image data read out from the band memory 204 is sequentially decremented.

In reality, at the point that the image data (C, M, Y) created by the image processing unit 201 is written to the band memory 204, and one band of image data has been prepared, the recording head 207 can be scanned. The recording head 207 is thus scanned, the image data is read out of the band memory 204, and the recording head 207 records the image based on the image data. Image data to be recorded next is created by the image processing unit 201 during the recording operation, and the image data is written to the area of the band memory 204 corresponding to the recording position thereof.

Thus, the band memory control switches between the task of writing the recording data (C, M, Y) created by the image processing unit 201 to the band memory 204, and the task of reading out the recording data (C, M, Y) to send to the head control unit 206 along with the scanning action of the carriage.

The following is a description of the mask memory control in FIG. 14.

This mask memory control is necessary in the event that multi-pass recording is used. In the case of multi-pass recording, one line of recording image having a width equivalent to the length of a nozzle row of the recording head 207 is recorded by multiple scans of the recording head 207. That is to say, the amount of transporting of the printing medium which is intermittently transported in the sub-scanning direction is set a 1/N of the length of the nozzle row, and in the event that, for example, N=2, one line of recording image is recorded by two scans (2-pass recording), and in the event that N=4, one line of recording image is recorded by four scans (4-pass recording). In the same way, in the event that N=8, one line of recording image is recorded by eight scans, and in the event that N=16, by sixteen scans. Accordingly, one line of recording image is completed by multiple scans of the recording head 207.

In reality, mask data for appropriating the image data to multiple scans of the recording head 207 is stored in the mask memory 205, and the recording head 207 discharges ink and records images based on the logical product (AND) data of the mask data and image data.

Also, in FIG. 14, the audio data stored in the CF card 105 is sent to the printer unit B100 via the interface 210, in the same manner as with the image data. The audio data sent to the printer unit B100 is encoded at the audio encoder 230 and recorded in the image to be printed as code data. In the event that there is no need to include audio data in the printed image, or in the event that an image with no audio data is to be printed, the encoded audio data is not printed, with only the image being printed, as a matter of course.

With the present embodiment, description has been made regarding a camera with a built-in printer, wherein the camera unit A100 and printer unit B100 are integrally formed. However, the same functions can be realized in an arrangement wherein the camera unit A100 and printer unit B100 are separate and individual devices, connected by the interface 210.

Characteristic Configurations

Next, description will be made regarding an embodiment of a characteristic configuration of the present invention.

Figure 15:
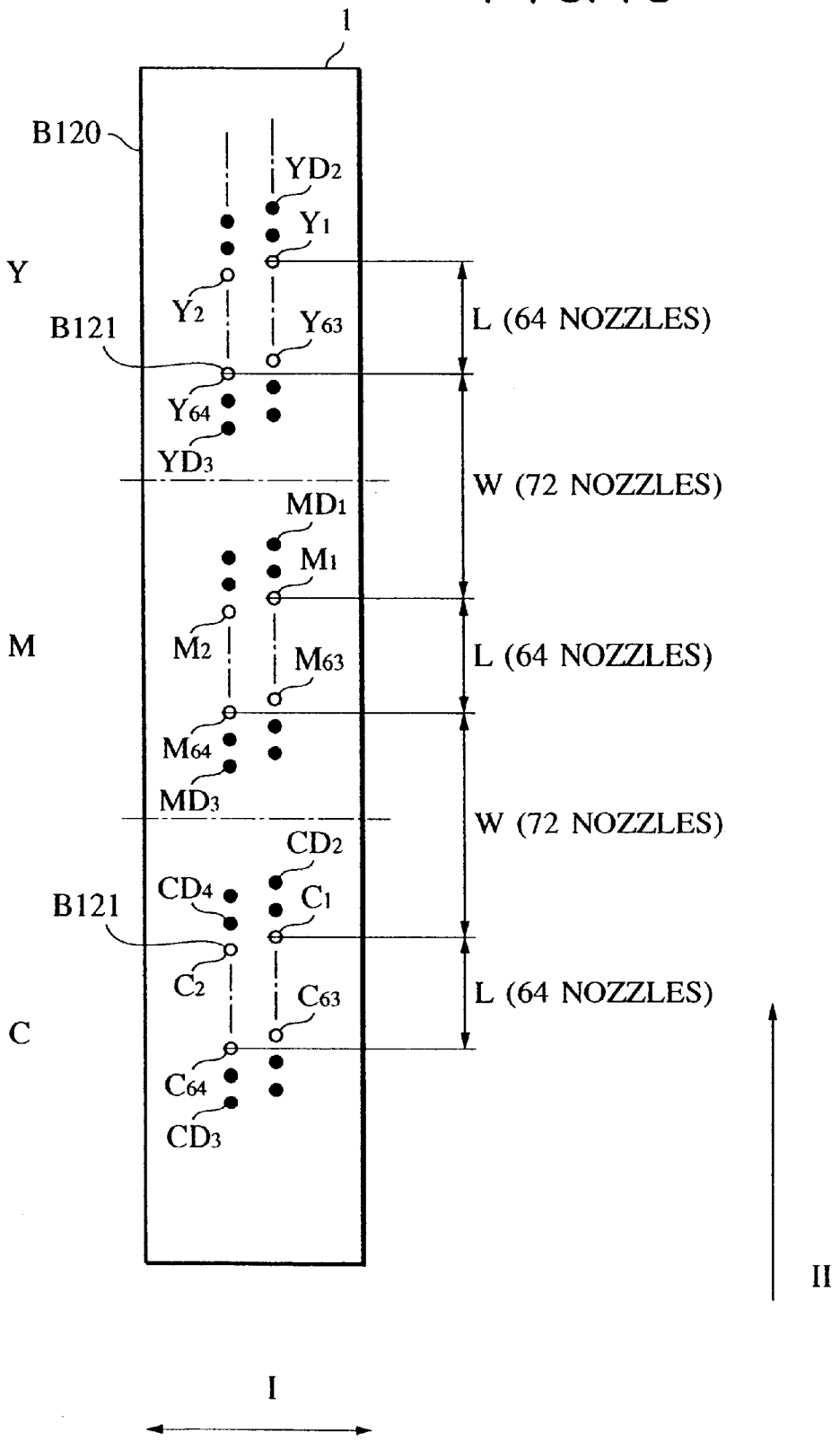
FIG. 15 is a plan view showing a blown-up view of the ink discharging orifice face of the recording head.

FIG. 15 is a plan view showing a blown-up view of the ink discharging orifice face 1 of the recording head B120 shown in FIG. 8.

As shown in FIG. 15, the recording head B120 has multiple ink discharging orifices B121 arrayed following the direction intersecting the main scanning direction (arrow I) (in the case of the present embodiment, a direction generally orthogonal), in other words, in approximately a straight line in approximately the same direction as the transporting direction of the printing medium (recording medium) C104 (arrow II). These ink discharging orifices B121 configure nozzles capable of discharging ink supplied from the sub-tank.

This recording head B120 discharges ink of the three colors of Y (yellow), M (magenta), and C (cyan), as described above.

The nozzle row for yellow (Y) ink is configured of 64 ink nozzles Y1 through Y64 for contributing to image formation by discharging yellow ink onto the printing medium C104, and eight dummy nozzles YD1 through YD8 (solid fill-in) arrayed four each on either side thereof.

The nozzle row for magenta (M) ink is configured of 64 ink nozzles M1 through M64 for contributing to image formation by discharging magenta ink onto the printing medium C104, and eight dummy nozzles MD1 through MD8 (solid fill-in) arrayed four each on either side thereof.

The nozzle row for cyan (C) ink is configured of 64 ink nozzles C1 through C64 for contributing to image formation by discharging cyan ink onto the printing medium C104, and eight dummy nozzles CD1 through CD8 (solid fill-in) arrayed four each on either side thereof.

The nozzle rows of each color have 32 nozzles arrayed on one side at the same pitch, and have 32 nozzles arrayed on the other side half a pitch off, so as to make a so-called staggered array, thereby realizing a 1200 dpi high-density array.

Also, the nozzle rows of each color are of an inline type wherein the rows are arrayed in approximately a straight line in approximately the same direction as the transporting direction of the recording medium C104 (arrow II).

Also, the dummy nozzles YD1 through YD8, MD1 through MD8, and CD1 through CD8, are arrayed so as to allow bubbles generated in the adjacent end ink nozzles Y1, Y2, Y63, Y64, M1, M2, M63, M64, C1, C2, C63, C64, and so forth, to escape to the nozzle dummies, or to keep the ink discharging properties of the end ink nozzles the same as those of the others by arrayed nozzles on either side of the end nozzles.

Now, the arraying spacing W of the nozzle rows of each color is set so as to be longer than the length L of the ink nozzle rows for discharging ink of each of the colors. That is to say, W>L holds. The dummy nozzles are positioned in the spacing W of the nozzle rows of each color.

With the present embodiment, the spacing W between the nozzle rows of each color is the equivalent of the space occupied by 72 nozzles, when converted into an equivalent number of nozzles. That is to say, the length L of the nozzle row of each color is the equivalent of the space occupied by 64 nozzles, and conversely the spacing W of the gap between nozzle rows of each color is longer than L (i.e., the equivalent of the space occupied by 72 nozzles).

Also, in this case, the transporting amount Δp of the recording medium C104 each time performed during scanning of the carriage B104, is the equivalent of the space occupied by 32 nozzles.

Figure 16:
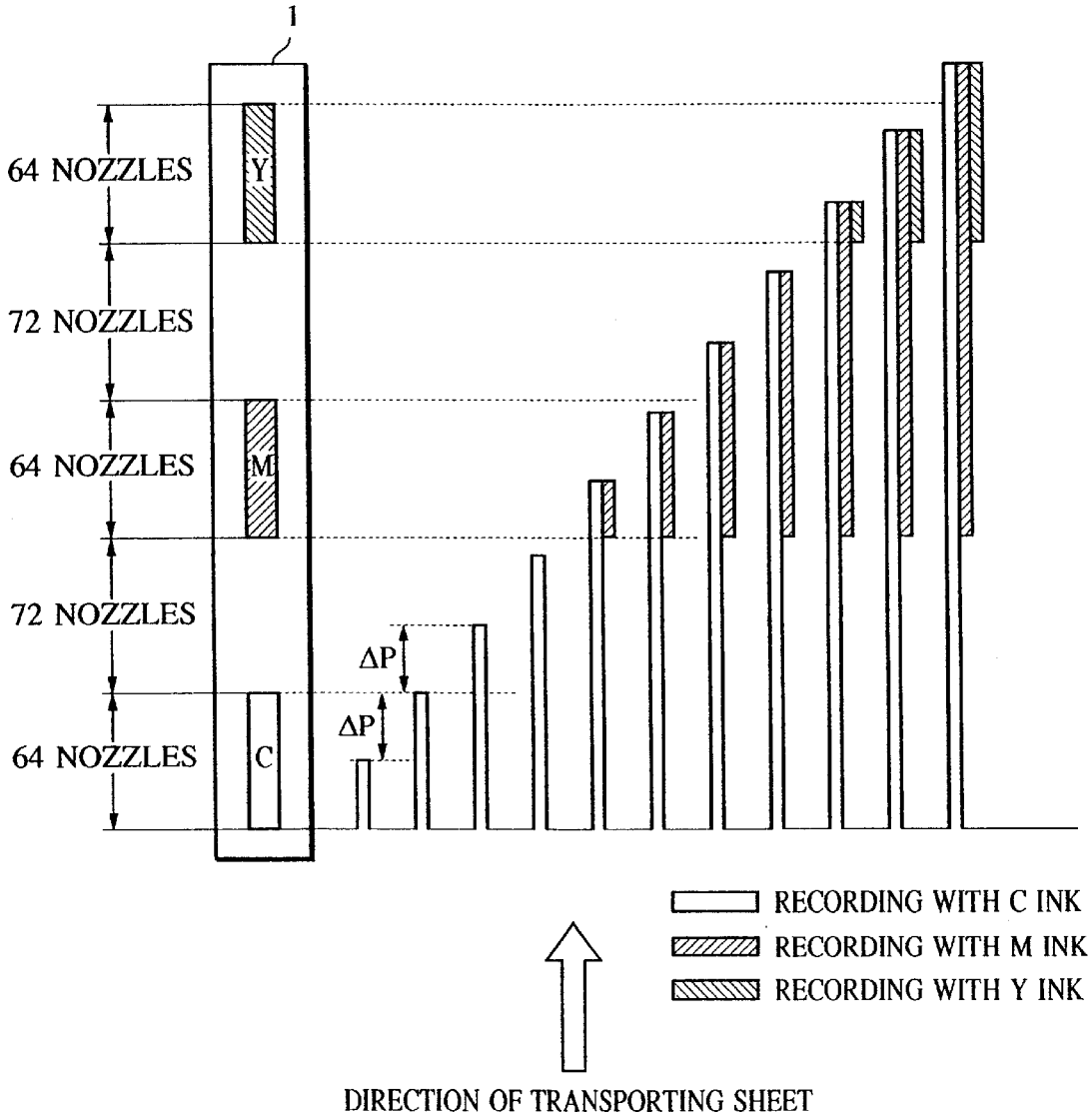
FIG. 16 is a diagram illustrating change in the overlapping of the colors according to transporting of the recording medium.

FIG. 16 is a diagram illustrating change in the overlapping of the colors according to transporting of the recording medium C104 in the event that the above transporting amount Δp is the equivalent of the space occupied by 32 nozzles.

In this case, let us say that for example, 2-pass multi-pass printing is performed. Multi-pass printing is performed by setting the sheet feeding amount to 1/N of the nozzles used (64 in this case) and printed N times with data subjected to complementary thinning out, thereby printing one raster line using multiple (an N number of) nozzles. In this case, one line worth, that is a recording image of 64 nozzles worth, is divided into two scans and recorded (the two scans being the traversing and returning scans).

Incidentally, in the event that multi-pass printing is not to be performed, recording may be performed using all nozzles each time that transporting is performed by 2 Δp worth (the equivalent of the space occupied by 64 nozzles).

In this way, the recording head B120 is a linear type, so the colors each land at different positions during each scan. Finally, the recording medium C104 is transported by 2 Δp worth following the scan.

At this time, according to this recording head B120, the spacing W between the colors is great, so time can be purchased until the ink lands during the next scan. Accordingly, time can be secured for the ink which has already landed to be sufficiently fixed. Thus, bleeding on the recording medium in high-speed recording can be prevented.

Also, the spacing W between the colors is great, so mixing of ink colors on the face 1 of the recording head B120 can be prevented. Accordingly, this arrangement is also advantageous regarding mixing of colors at the time of recovery processing of the recording head, such as suctioning recovery and preliminary discharging. Further, this enables using inline recording heads for reactive inks, which has been difficult conventionally.

Also, according to this recording head, the nozzle rows for each color are configured of 64 nozzles, and the spacing W for the nozzle rows for each color is the equivalent of the space occupied by 72 nozzles, and further the transporting amount of the recording medium C104 each time is Δp (which is the equivalent of the space occupied by 32 nozzles), each of these being multiples of 8.

This is since the band memory 204 shown in FIG. 14 is managed in increments of band buffers storing eight scanning lines of discharging data, and the band memory 204 contains band buffers for at least 8 by 3 pieces of recording data and band buffers for three pieces of dummy nozzle data, thereby facilitating managing of the data by making the number of nozzles, the spacing between the nozzles, and the transporting amount of the recording medium, to be multiples of 8.

Now, in the above embodiment, the nozzle array is staggered, but the nozzle array may be in a straight line, or may be in yet another array.

With the present embodiment, description has been made regarding an arrangement wherein the nozzle row spacing for each of the colors is longer than the nozzle lengths of all, but with the present embodiment, it is sufficient that the nozzle row spacing be wider than the shortest nozzle row length. That is, depending on the type of ink used, not all inter-color spacings need to be longer than the nozzle rows, such as with cases wherein there is a nozzle row discharging ink with excellent fixing properties.

The present invention has been made regarding a three-color head of the colors yellow, magenta, and cyan, but the present invention is not restricted to this, and is also advantageous for an arrangement wherein a black nozzle row is added to the above three colors. In this case, it is advantageous from the perspective of recording speed to have the black nozzle row longer than the color nozzles.

Also, the recording head according to the present invention is also applicable to the so-called bubble jet method wherein thermal energy is generated to discharge ink, or the piezo method using piezo devices.

Thus, as described above, according to the present invention, the array spacing of nozzle rows of each color is greater than the nozzle row length L for discharging ink of each of the colors, so high-quality recording with little bleeding, mixing of colors, etc., can be provided at low costs, even when using very small heads or printing at high speeds.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modification and equivalent structures and functions.

What is claimed is:

1. An ink-jet recording head comprising a plurality of nozzle rows for discharging ink of different colors, wherein said rows are arranged by color and are aligned with each other in approximately a straight line, so that both the rows and the straight line are in approximately the same direction as a transporting direction of a recording medium, and so that the nozzles within said rows are not aligned in a direction perpendicular to the transporting direction of the recording medium, with images being recorded on the recording medium by scanning the ink-jet recording head in a main scanning direction, wherein the main scanning direction is perpendicular to the transporting direction of the recording medium, wherein a distance between the nozzle rows of different colors is greater than a length of a shortest nozzle row, and wherein a dummy nozzle is positioned between the nozzle rows.

2. An ink-jet recording head according to claim 1, wherein a plurality of nozzles arrayed in each of said nozzle rows are disposed in a staggered array.

3. An ink-jet recording head according to claim 1, further comprising electro-thermal converters for discharging ink by applying thermal energy to ink.

4. An ink-jet recording apparatus which scans an ink-jet recording head in a direction perpendicular to an arrayed direction of a plurality of nozzle rows relative to a recording medium, and which transports the recording medium in predetermined increments relative to said recording head in a direction different from said scanning direction, thereby performing recording operations, wherein images are formed on said recording medium using an ink-jet recording head according to claim 2.

5. An ink-jet recording head according to claim 1, wherein the distance between the nozzle rows, a length of the nozzle rows, and a transporting distance of the recording medium per unit of time, each correspond to a number of distance units, said distance unit being defined as one-half of a distance between adjacent nozzles of one of said nozzle rows in the transporting direction of the recording medium, wherein the number of distance units corresponding to the distance between the nozzle rows, the number of distance units corresponding to the length of the nozzle rows, and the number of distance units corresponding to the transporting distance of the recording medium per unit of time, are all whole-number multiples of a single natural number n, and wherein the natural number n is a non-negative whole number.

6. An ink-jet recording head comprising a plurality of nozzle rows for discharging ink of different colors, wherein said rows are arranged by color and are aligned with each other in approximately a straight line, so that both the rows and the straight line are in approximately the same direction as a transporting direction of a recording medium, and so that the nozzles within said rows are not aligned in a direction perpendicular to the transporting direction of the recording medium, with images being recorded on the recording medium by scanning the ink-jet recording head in a main scanning direction, wherein the main scanning direction is perpendicular to the transporting direction of the recording medium, wherein a distance between the nozzle rows of different colors is greater than a length of a shortest nozzle row, wherein the distance between the nozzle rows, a length of the nozzle rows, and a transporting distance of the recording medium per unit of time, each correspond to a number of distance units, said distance unit being defined as one-half of a distance between adjacent nozzles of one of said nozzle rows in the transporting direction of the recording medium, wherein the number of distance units corresponding to the distance between the nozzle rows, the number of distance units corresponding to the length of the nozzle rows, and the number of distance units corresponding to the transporting distance of the recording medium per unit of time, are all whole-number multiples of a single natural number n, and wherein the natural number n is a non-negative whole number.

* * * * *

UNITED STATES PATENT AND TRADEMARK OFFICE

CERTIFICATE OF CORRECTION

PATENT NO. : 6,688,728 B2
DATED : February 10, 2004
INVENTOR(S) : Takashi Watanabe et al.

It is certified that error appears in the above-identified patent and that said Letters Patent is hereby corrected as shown below:

Column 4,
Line 12, ""link"" should read -- "ink" --.

Column 8,
Line 66, "A air-liquid" should read -- An air-liquid --.

Column 9,
Line
1, "he sub-tank" should read -- the sub-tank --.

Signed and Sealed this

Thirteenth Day of July, 2004

JON W. DUDAS
*Acting Director of the United States Patent and Trademark Office*